US010510216B2

(12) United States Patent
Waters et al.

(10) Patent No.: US 10,510,216 B2
(45) Date of Patent: Dec. 17, 2019

(54) ELECTRONIC GAMING SYSTEM FOR PLAYING A BINGO-TYPE GAME

(71) Applicant: Ainsworth Game Technology Limited, Newington (AU)

(72) Inventors: David B. Waters, Las Vegas, NV (US); Richard Grabowski, Greenville, SC (US)

(73) Assignee: Ainsworth Game Technology Limited, Newington, NSW (AU)

( * ) Notice: Subject to any disclaimer, the term of this patent is extended or adjusted under 35 U.S.C. 154(b) by 0 days.

(21) Appl. No.: 15/658,616

(22) Filed: Jul. 25, 2017

(65) Prior Publication Data

US 2018/0025587 A1 Jan. 25, 2018

Related U.S. Application Data

(60) Provisional application No. 62/366,486, filed on Jul. 25, 2016.

(51) Int. Cl.
*G07F 17/32* (2006.01)
*G07F 17/34* (2006.01)

(52) U.S. Cl.
CPC ..... *G07F 17/3286* (2013.01); *G07F 17/3225* (2013.01); *G07F 17/3246* (2013.01); *G07F 17/3248* (2013.01); *G07F 17/3258* (2013.01); *G07F 17/34* (2013.01)

(58) Field of Classification Search
CPC ..... G07F 17/32
See application file for complete search history.

(56) References Cited

U.S. PATENT DOCUMENTS

| | | | | |
|---|---|---|---|---|
| 6,398,645 | B1 * | 6/2002 | Yoseloff ..... | G07F 17/3262 273/269 |
| 7,481,707 | B1 | 1/2009 | Luciano, Jr. et al. | |
| 7,794,319 | B2 | 9/2010 | Luciano, Jr. et al. | |
| 8,636,578 | B2 | 1/2014 | Olsen | |
| 8,647,199 | B2 | 2/2014 | Luciano, Jr. et al. | |
| 8,845,412 | B2 | 9/2014 | Olsen | |
| 2003/0104854 | A1 * | 6/2003 | Cannon ..... | G07F 17/3244 463/16 |

* cited by examiner

*Primary Examiner* — Kevin Y Kim
(74) *Attorney, Agent, or Firm* — Cook Alex Ltd.

(57) ABSTRACT

An electronic gaming system includes a plurality of electronic gaming machines including a display, a wager acceptor to receive value, and a controller, and a server in communication with the gaming machines. The server is configured to determine the machines participating in a session of a bingo-type game with a progressive prize; collect a portion of a wager received at each of the machines, wherein the size of the wager may vary; determine a number of virtual bingo cards for each of the machines in accordance with the size of the wager received; issue the virtual bingo cards to each of the machines in accordance with the determination; generate one or more sets of indicia; determine a progressive win event based on the virtual bingo cards and the one or more sets of indicia; and award the progressive prize to the machine associated with the win event.

14 Claims, 8 Drawing Sheets

ELECTRONIC GAMING SYSTEM FOR PLAYING A BINGO-TYPE GAME

BACKGROUND

This patent is directed to an electronic gaming system for playing a bingo-type game, and, in particular, to an electronic gaming system for playing a bingo-type game that permits equitable adjustment of probabilities of achieving a win event.

Many players in the United States and elsewhere enjoy playing a class of games of chance that have been referred to commonly as bingo. In broad terms, each player has a card with an array of unique numbers that are selected from a larger set of numbers, and numbers from within the larger set are selected, often one at a time, until a player matches the numbers on their card with the selected numbers in a particular pattern. For example, the card may have an array of five columns, each associated with one of the letters B-I-N-G-O. The game play continue until the phrase "BINGO" is spelled by one of the players in accordance with the matching of the numbers on the card with the numbers selected.

Electronic gaming machines have been designed to permit players to play bingo-type games in groups, and to wager on the outcomes. Not all players will want to wager the same amount on the game, however. Some players will want to wager only enough to join the game, while other players will want to wager as much as permitted. This presents an issue for the organization that is running the bingo-type game, because there is a desire to permit both low-wager and high-wager players to play the same game.

To a certain extent, designers and manufacturers of bingo-type electronic gaming machines have addressed the issue by scaling the prize or award. That is, if a first player wagers one dollar and a second player wagers ten dollars, and then both participate in a single bingo-type game, the first player might win ten dollars for matching a particular pattern, while a second player may win one hundred dollars for matching the same pattern. This system provides equal probability and prize-to-wager equality.

In addition to prizes or awards of fixed value or amount, designer and manufacturers of bingo-type electronic gaming machines would like to provide awards that increase in value based on player participation. For example, in a progressive game, each player contributes a portion of their wager to a pot; as more wagers are received, the jackpot increases.

The progressive game presents issues for bingo-type gaming machine designers and manufacturers. Players who wager more than players who wager less contribute more to the progressive pot, but if the bingo-type game is used to assess a win of the progressive pot, all players would have an equal probability to win the pot. Thus, there is equal probability, but no prize-to-award equality.

The generally accepted solution is to implement the progressive jackpot in the following fashion for those electronic gaming machines designated to participate in a progressive jackpot. The wagers from all participating machines contribute to the progressive jackpot, regardless of the size of the wager: a player wagering one dollar contributes the same percentage of the bet as a player wagering ten dollars. Only players that wager the maximum amount are permitted to win the progressive jackpot, however. This solution maintains prize-to-wager equality, while the game provides equal probability for the players in the group that are eligible to win the progressive.

This solution to the issues of equal probability and prize-to-wager equality in the context of a progressive jackpot has the effect of disenfranchising the players that wager less than the maximum amount: they contribute to the progressive prize but are unable to win the progressive prize. A further solution is therefore adopted for these players: the non-maximum bet players are awarded a scaled value relative to the reset value of the progressive jackpot. If a jackpot is reset to one hundred dollars once awarded, the player wagering the minimum amount might win ten dollars, the player wager twice that amount might win twenty dollars.

The solution permitting only players wagering the maximum amount to participate in the progressive jackpot cause other problems as well. For example, by limiting the pool of players to only those that wager the maximum amount, the pool of players is relatively small, perhaps 5% of all players. Consequently, where the progressive is intended to be won at a particular frequency by design, the small pool of possible winners can have the effect of adjusting the frequency from the designed value.

SUMMARY

According to one aspect of the present disclosure, an electronic gaming system for playing a bingo-type game includes a plurality of electronic gaming machines including a display, a wager acceptor to receive value and a controller coupled to the display and the wager acceptor, and a server in communication with the wager acceptor. The server is configured to determine the electronic gaming machines participating in a session of a bingo-type game with a progressive prize; collect a portion of a wager received at each of the electronic gaming machines to participate in the session, wherein a size of the wager received at each of the electronic gaming machines may vary among the plurality of electronic gaming machines; determine a number of virtual bingo cards for each of the electronic gaming machines participating the session in accordance with the size of the wager received at each of the electronic gaming machines; issue the virtual bingo cards to each of the electronic gaming machines in accordance with the determination; generate one or more sets of indicia; determine a progressive win event based on the virtual bingo cards and the one or more sets of indicia; and award the progressive prize to the electronic gaming machine associated with the win event.

According to another aspect of the present disclosure, an electronic gaming system for playing a bingo-type game includes a plurality of electronic gaming machines including a display, a wager acceptor to receive value in the form of coin, bill or ticket and a controller coupled to the display and the wager acceptor; and a server in communication with the gaming machine. The server is configured to determine the electronic gaming machines participating in a session of a bingo-type game with a scaled prize and a progressive prize; collect a portion of a wager received at each of the electronic gaming machines to participate in the session, wherein a size of the wager received at each of the electronic gaming machines may vary among the plurality of electronic gaming machines; determine a set of virtual bingo cards for the bingo-type game with the progressive prize for each of the electronic gaming machines participating the session in accordance with the size of the wager received at each of the electronic gaming machines; issue virtual bingo cards to each of the electronic gaming machines including the set of virtual bingo cards; generate one or more sets of indicia; determine one or more win events based on one of the virtual bingo cards issued to each of the electronic gaming machines and the one or more sets of indicia; award one or more scaled prizes based on the one or more win events; determine a progressive win event based on the set of virtual bingo cards issued to each of the electronic gaming machines and the one or more sets of indicia; and award the progressive prize to the electronic gaming machine associated with the win event.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings is necessarily to scale.

DETAILED DESCRIPTION OF VARIOUS EMBODIMENTS

Figure 1:
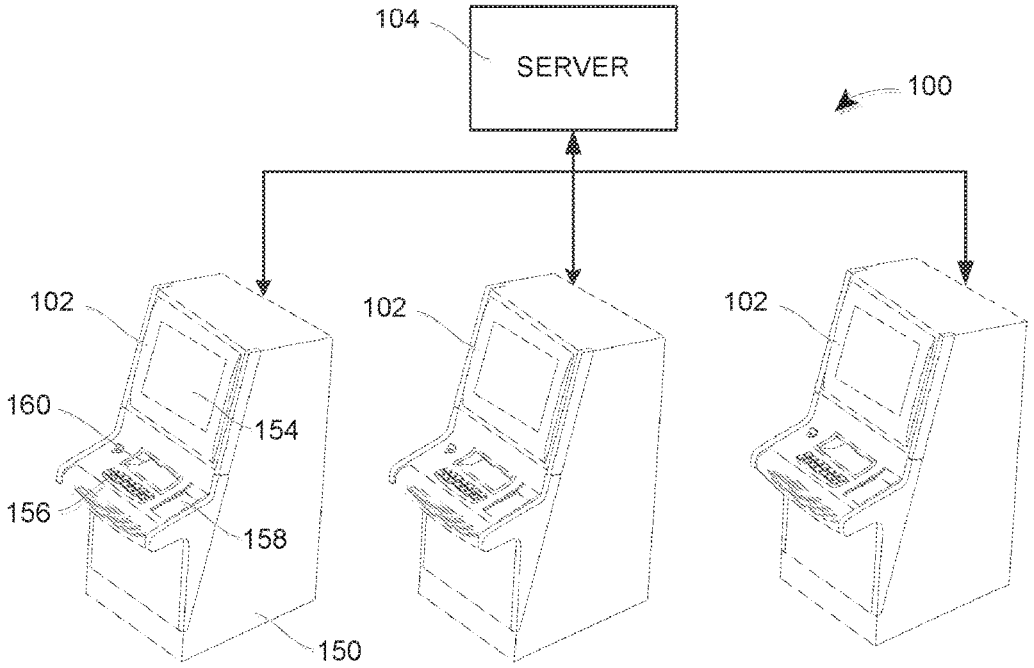
FIG. 1 is a schematic of a system of electronic gaming machines according to an embodiment.

FIG. 1 illustrates a system 100 used for playing a bingo-type game. The system 100 includes one or more electronic gaming machines (or terminals) 102 on which the bingo-type game is played. The system 100 may include one or more network computers or servers 104 that are connected to the electronic gaming machines 102 so that there is at least communication between the electronic gaming machines 102 and the server 104. According to certain embodiments, the server(s) 104 may be defined by one or more electrical circuit components. According to other embodiments, the server(s) 104 may be defined by one or more processors that may be programmed to perform the actions of the server 104. According to still further embodiments, the server 104 may be defined in part by electrical circuit components and in part by a processor(s) programmed to perform the actions of the server 104. The instructions by which the processor(s) is/are programmed may be stored on a memory associated with the processor, which memory may include one or more tangible non-transitory computer readable memories, having computer executable instructions stored thereon, which when executed by the processor, may cause the one or more processors to carry out one or more actions.

Figure 2:
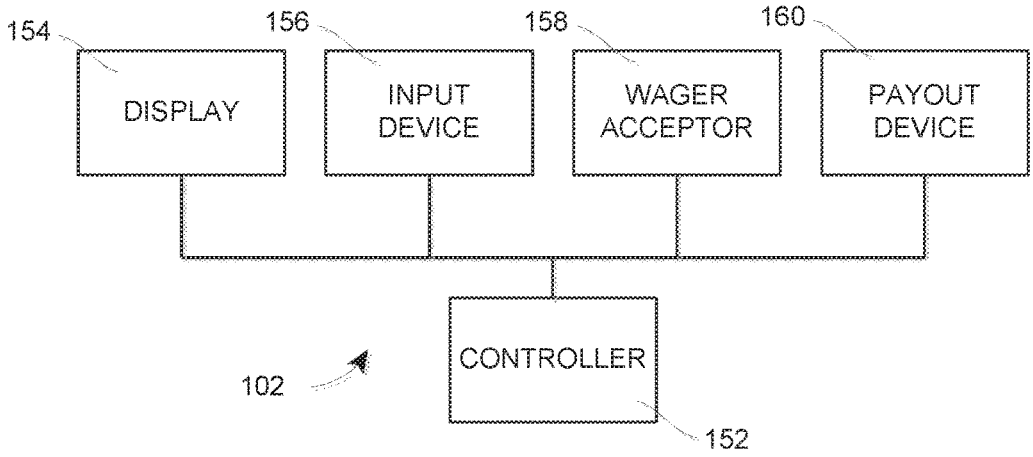
FIG. 2 is a block diagram of an electronic gaming machine that may be used in the system of FIG. 1.

According to an embodiment illustrated in FIGS. 1 and 2, one or more of the electronic gaming machines 102 include a cabinet 150 in which is disposed or mounted a controller 152 (FIG. 2). Similar to the server 104, the controller 152 may be defined by one or more electrical circuit components, may be defined by one or more processors that may be programmed to perform the actions of the controller 152, or in part by electrical circuit components and in part by a processor(s) programmed to perform the actions of the controller 152. The instructions by which the processor(s) is/are programmed may be stored on a memory associated with the processor, which memory may include one or more tangible non-transitory computer readable memories, having computer executable instructions stored thereon, which when executed by the processor, may cause the one or more processors to carry out one or more actions. The controller 152 is coupled to and in communication with one or more displays 154, one or more input devices 156, one or more wager acceptors 158 and one or more award payout devices 160. The one of more input devices 156 may be in the form of one or more buttons, or may be in the form of a touch screen that is used in association with the display 154. Further, the wager acceptor 158 may be in the form of a coin acceptor, a paper currency (or bill) acceptor, and a ticket reader and/or printer. The ticket printer may also define an award payout device 160. The controller 152 may be coupled to the display(s) 154, input device(s) 156, wager acceptor(s) 158, and payout device(s) 160 via a common bus, or the controller 152 may be connected to each separately or through separate buses. Further variations on the electronic gaming machine and the display, input devices, wager acceptors, and payout devices are provided below.

Figure 3:
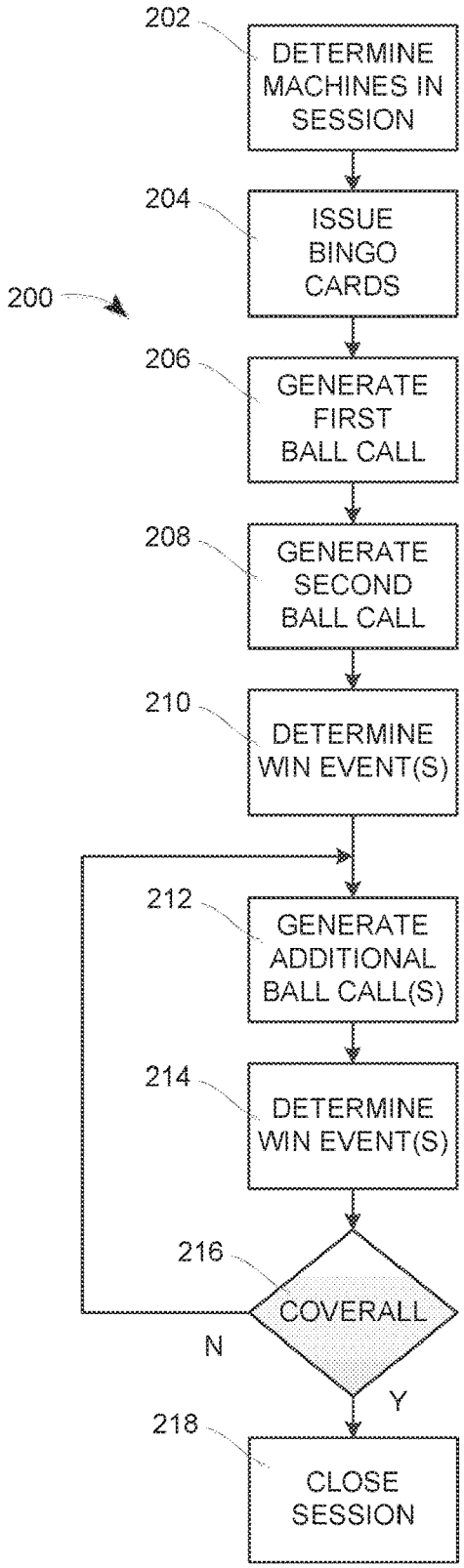
FIG. 3 is a method of operating the system of FIG. 1 to provide a bingo-type game with a scaled prize or award.

As mentioned above, the electronic gaming machines 100 play a bingo-type game with a scaled prize or award. FIG. 3 illustrates an exemplary method 200 for playing one such bingo-type game. According to the illustrated method 200, at least two gaming machines 102 participate in a session of a bingo-type game with a scaled prize or award.

At block 202, the server 104 determines which gaming machines 102 will participate in a session of the bingo-type game. The server 104 may determine which gaming machines 102 will participate in a session by determining if a wager has been received at a particular gaming machine 102 within a particular time frame (e.g., after time 1 but before time 2). The gaming machine 102 may determine that a wager has been received when value (in the form of, for example, coins, bills, or tickets) is deposited into the wager acceptor 158 of a particular gaming machine 102. Alternatively, the gaming machine 102 may determine that a wager has been received when the player uses an input device 156 (e.g., a "BET ONE" button) within a particular time frame. In either event, the server 104 may determine if the wager has been received by the gaming machine 102 by polling the individual machines 102 or by receiving a communication from the controller 152 of the machine 102, for example.

After the server 104 has determined which machines 102 will participate in the session at block 202, the server 104 then issues a globally unique virtual bingo card to each of the gaming machines 102 that are participating in the present session of the bingo-type game at block 204. According to one non-limiting embodiment, each virtual bingo card may be represented as a 5 row by 5 column array of cells. Each of the cells of the bingo card may have a unique (i.e., non-repeated) indicia associated therewith when issued. According to one convention, the indicia for the cells in the first column are from the group (B)1-15, in the second column from the group (I)16-30, in the third column from the group (N)31-45, in the fourth column from the group (G)46-60 and in the fifth column from the group (O)61-75.

According to certain embodiments of the method 200, the bingo card(s) are immediately displayed to the player via the display(s) 154. According to other embodiments, the card(s) are displayed to the player upon receipt of an input by the controller 152 via the input device(s) 156. According to still other embodiments, the card(s) are displayed to the player when an event occurs, e.g., when a win event occurs. According to other embodiments, the player never may see the virtual cards assigned to their gaming machine 102.

Play commences at block 206 with the server 104 determining a first set of indicia (e.g., numbers) that will be compared against each of the virtual bingo cards participating in the session. According to one convention, this action may be referred to as a "ball call". According to certain embodiments, the first set of indicia may include two separate numbers (or "balls"). The server 104 may determine the first set of numbers with reference to a random number generator, which may be used to select the numbers in a random or quasi-random fashion. The server 104 may determine whether the virtual card(s) associated with a gaming machine 102 includes has any of the numbers of the first set of numbers, or the first set of numbers may be transmitted to the gaming machine 102 and the controller 152 may make the determination.

Play continues at block 208 with the server 104 determining a second set of numbers. According to certain embodiments, the second set of numbers may include 22 separate numbers. After the second set of numbers has been generated, a determination is made at block 210 if a win event has occurred.

According to one embodiment, a win (or winning) event occurs when the numbers from the first and second set (e.g., the 24 numbers or "balls") are found in one or more particular patterns on one or more of the virtual bingo cards. For example, one pattern may include all of the cells of the third row, while another pattern may include all of the cells in the corners of the array (i.e., the first cell in the top and bottom rows of the leftmost column and the last cell in the top and bottom rows of the rightmost column). The patterns used to make the determination are independent of the size of the wager received at the gaming machine 102. That is, if a first gaming machine receives a wager of 1 dollar and a second gaming machine receives a wager of 10 dollars, the server 104 will determine that both gaming machines 102 are participating in a single session, will issue a virtual bingo card to each gaming machine 102, and the cards will be inspected for the same pattern or patterns.

According to certain embodiments, the server 104 may determine which virtual bingo cards have win events associated therewith, by comparing the numbers from the first and second sets to the indicia associated with the virtual bingo cards. The server 104 may then notify the gaming machine(s) 102 associated with the win event(s). Alternatively, the server 104 may transmit the first and second set of numbers to the gaming machines 102, and the gaming machines 102 may make the determination if there are any win events associated with the bingo card(s) associated with that gaming machine 102.

Each of these win events may be associated with one or more images that may be displayed to the player via the display 154 associated with the gaming machine 102. The one or more images may include animations or animated images. The server 102 may transmit the images associated with the win events to the gaming machines 102, or as one alternative, the gaming machines may have a library of images located locally within the gaming machine 102 from which the controller 154 selects an image based on the win event. Each win event may have a unique image associated therewith, or multiple images may be associated with a win event or vice versa. If more than one image is associated with a win event, for example, the image to be displayed to the player may be selected in a random or quasi-random fashion, for example.

According to one embodiment, an image may be displayed to the player that represents the virtual bingo card as a 5 row by 5 column array with the win event displayed on the bingo card, for example by having certain cells highlighted or shaded in a contrasting color. In addition or in the alternative, one or more images of associated with a slots-type game may be displayed to the player. For example, the display 154 may display a series of animations similar to that of the operation of a slot machine, starting with a plurality (e.g., five) reels spinning so that the indicia associated with each of the reels is not immediately apparent, continuing with each of the reels "stopping" to display certain indicia that is apparent, and ending with all five reels stopped to display indicia, which indicia may be associated with a "winning combination" along one or more pay lines. In this fashion, the win event may be displayed to the player using images related to a bingo-type game and/or to a slots-type game. However, the image displayed to the player does not change the fact that the operation of the system 100 is according to a bingo-type game.

Each of these win events may be associated with a prize or award that may be provided to the player. According to certain embodiments, if the virtual bingo card(s) associated with one gaming machine 102 are associated with more than one win event, then the system 100 may determine that the player associated with that gaming machine 102 will receive only one of the prizes or awards associated with the plurality of win events (e.g., the prize or award with the highest value). This determination may have an effect on the image displayed to the player, in particular where one or more images of a slots-type game are displayed to the player to represent the win event. According to other embodiments, the player may receive the prize or award associated with each win event. The controller 152 may add the prize or award to any value (e.g., in the form of credits) presently associated with the player and/or the controller may be provided value (in the form of coins, bills, or tickets) to the player via the payout device 160 upon the controller 152 receiving a signal from the player via the input device 156, for example.

Because this is a bingo-type game with scaled prize or award, while the pattern or patterns used to determine a win event do not vary according to the size of the wager, the size or amount of the prize or award provided to the player may vary according to the size or amount of the wager received from the player. For example, if a wager of one dollar is required to participate in the session, but a player wagers three dollars, then the prize or award may be multiplied by three. Consequently, a prize or award that would have been worth one hundred dollars to a player that wagered one dollar would be worth three hundred dollars to a player that wagered three dollars on the session.

After block 210, the method 200 may continue to generate additional ball calls (i.e., sets of indicia) at block 212 until all of the indicia associated with one of the virtual bingo cards has been generated (i.e. the virtual bingo card is complete or a "coverall" has occurred) as determined at block 216. After each additional ball call, a further determination at block 214 may be made by the server 104 or the gaming machine 102 whether a win event has occurred. The server 104 may perform these additional ball calls one at a time until one of the virtual bingo cards is complete. At this point, the session may be closed at block 218.

It is possible for no win events to be associated with a particular gaming machine 102. If this occurs, then one or more images may be displayed to the player associated with the no-win event. For example, the controller 154 may control the display 154 to display an image of a virtual bingo card with a 5 row by 5 column array wherein none of the "winning" patterns is displayed. In addition or in the alternative, the display 154 may display a series of animations similar to that of the operation of a slot machine, starting with a plurality (e.g., five) reels spinning so that the indicia associated with each of the reels is not immediately apparent, continuing with each of the reels stopping to display certain indicia, and ending with all five reels stopped to display indicia that are not associated with any "winning combination" along the "active" pay lines.

Figure 4:
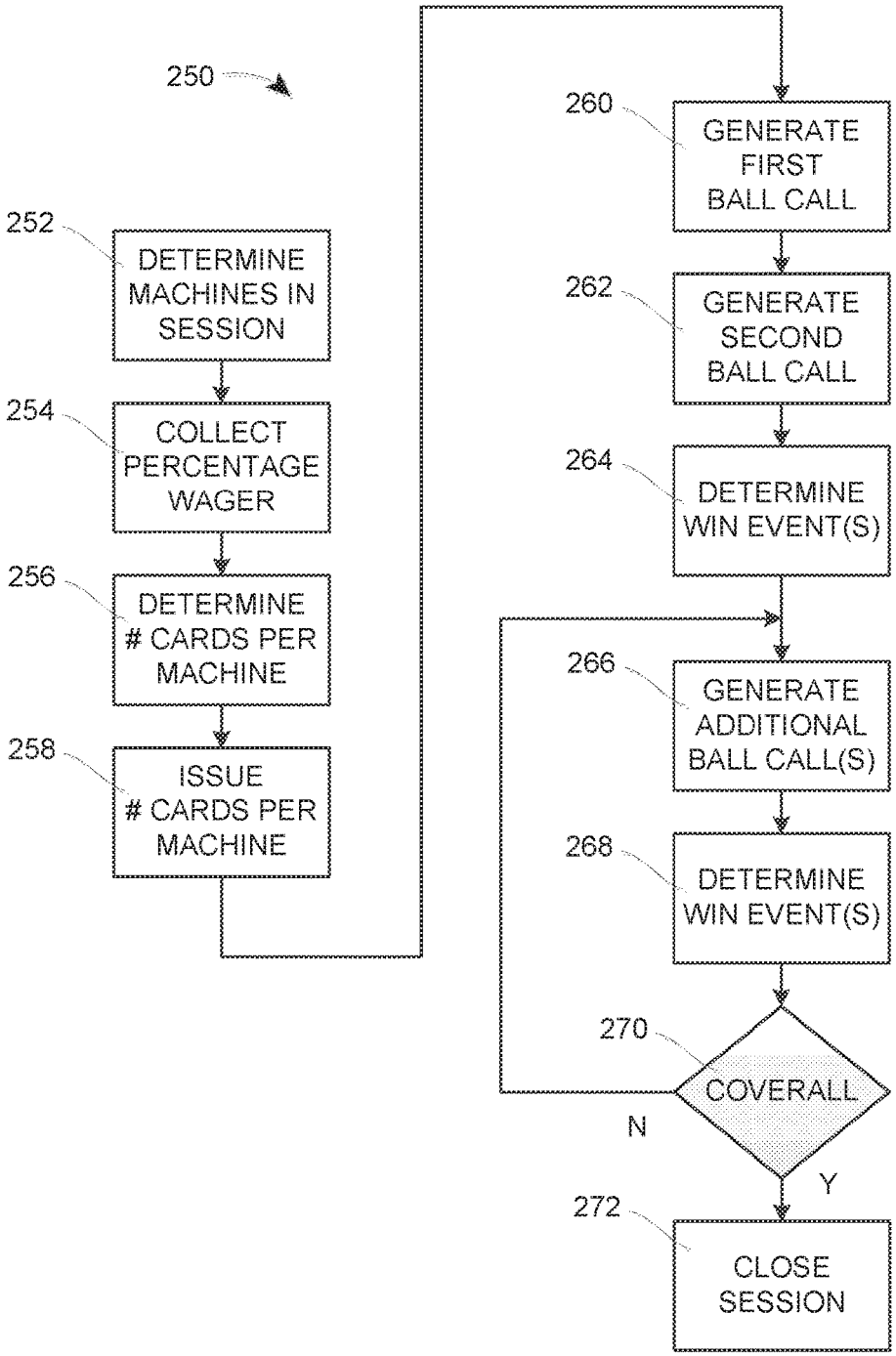
FIG. 4 is a method of operating the system of FIG. 1 to provide a bingo-type game with a progressive prize or award.

In addition to the foregoing, an embodiment of a gaming machine 102 of the system 100 may additionally provide an opportunity for the player to participate in a bingo-type game with progressive award. A method 250 of operating the system 100 to provide the progressive prize according to an embodiment is illustrated in FIG. 4. Unlike the operation of conventional systems and methods, the method 250 permits players to participate in a progressive prize without limiting the award of the progressive prize to only those players wagering the maximum amount.

According to the method 250, the server 104 determines at block 252 which gaming machines 102 will participate in the progressive jackpot. The server may make this determination based on which gaming machines 102 designated by a casino operator, for example, to be part of the progressive jackpot group have received a wager. According to other embodiments, the player may be able to select a progressive jackpot by making a wager via one of the gaming machines 102 and by using the input device 156 to indicate that they wish to participate in the progressive jackpot associated with that gaming machine 102. According to other embodiments, the player may use the input device 156 to indicate to the controller 152 that they wish to participate in one of a plurality of progressive jackpots that are accessible through the gaming machine 102. This selection may be the result of satisfying a minimum wager amount, or because of a selection of the progressive made by clicking on an image associated with that progressive.

Once the determination is made at block 252 as to which gaming machines 102 will participate in the progressive jackpot, the server 104 collects a portion of the wagers from each of the participating gaming machines 102 and deposits the wagers into the progressive prize or award pot at block 254. The server 104 collects a portion of each of the wagers according to a common percentage. For example, if the percentage is 10%, then the server 104 collects (or the gaming machine 102 transmits) one dollar of a ten dollar wager, or ten dollars of a one hundred dollar wager.

At block 256, the server 104 then determines the number of cards to issue to each of the gaming machines 102. Unlike the method 200 where a scaled prize is awarded and a single virtual bingo card is issued to each gaming machine 102, according to the method 250, the server 104 determines the number of bingo cards to issue to each gaming machine according to the size of the wager. Accordingly, the server 104 may issue one virtual bingo card to a gaming machine 102 where a wager of one dollar is awarded, two virtual bingo cards to a gaming machine 102 where a wager of two dollars is awarded, and so on. The server 104 may issue n virtual bingo cards to a gaming machine 102 where a wager of n dollars is received, up to the maximum amount permitted. The server issues the cards at block 258.

In this fashion, each player has an adjusted opportunity according to the size of his or her wager. While each card has an equal probability of a win event, the gaming machine 102 where the player has entered a larger wager has a greater number of chances to achieve the win event than a gaming machine 102 where the player has entered a smaller wager. Furthermore, all players would participate in the same drawing for the same progressive prize, such that even a player with a smaller wager might win the progressive prize.

As for the remainder of the game, the actions occurring at blocks 260, 262, 264, 266, 268, 270, 272 are the same as those at blocks 206, 208, 210, 212, 214, 216, 218 above. That is, a number of ball calls are generated and win events determined based on a comparison of the ball calls with the virtual bingo cards. In this fashion, the method 250 of carrying out a bingo-type game with progressive prize does not require significant reconfiguring or reprogramming of the gaming machine 102 to carry out both a bingo-type game with a scaled prize and a bingo-type game with a progressive prize.

Figure 5:
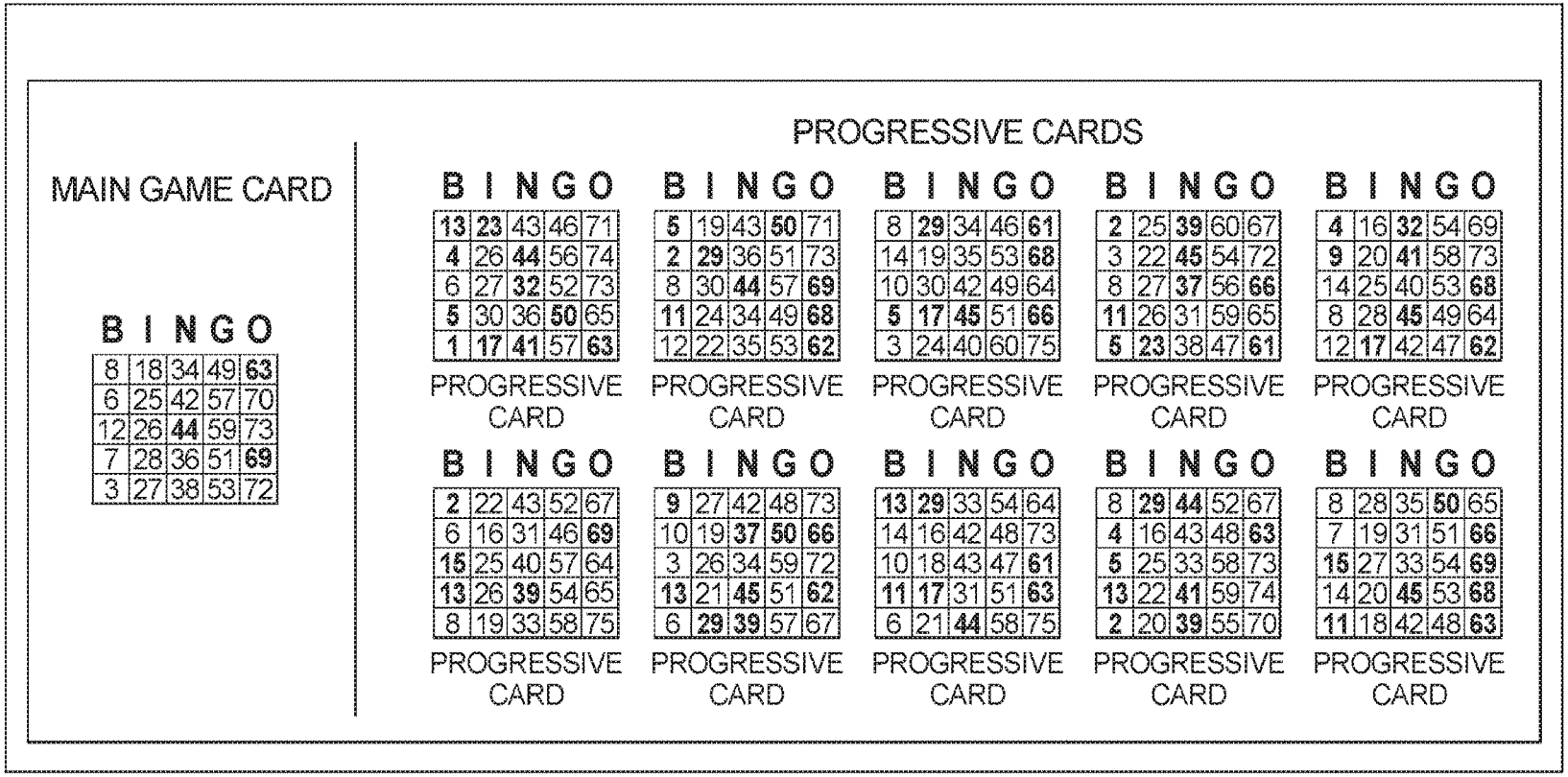
FIG. 5 is a screenshot of a first image displayed on the display of an electronic gaming machine illustrated in FIG. 1.

In fact, according to certain embodiments, the system 100 may carry out a bingo-type game with a scaled prize or award at the same time as a bingo-type game with a progressive prize or award. According to some embodiments, the system 100 would operate according to the method described in 250 except that (i) one virtual bingo card for that gaming machine 102 would participate in the game with scaled prize or award while a separate set of virtual bingo cards (of a number determined by the size or amount of the wager) for that gaming machine 102 would be used for the bingo-type game with progressive prize or award and (ii) different patterns would be used for the determination of the game with scaled prize and the game with progressive prize or award. A screenshot of the virtual bingo cards for such an embodiment of the gaming system might appear as illustrated in FIG. 5. According to other embodiments, the system 100 would operate according to the method described in 250 except that (i) one of the virtual bingo cards for that gaming machine 102 would participate in both the game with scaled prize or award and the bingo-type game with progressive prize or award while the remaining cards for that gaming machine 102 would participate only in the bingo-type game with progressive award and (ii) different patterns would be used for the determination of the game with scaled prize and the game with progressive prize or award.

Figure 6:
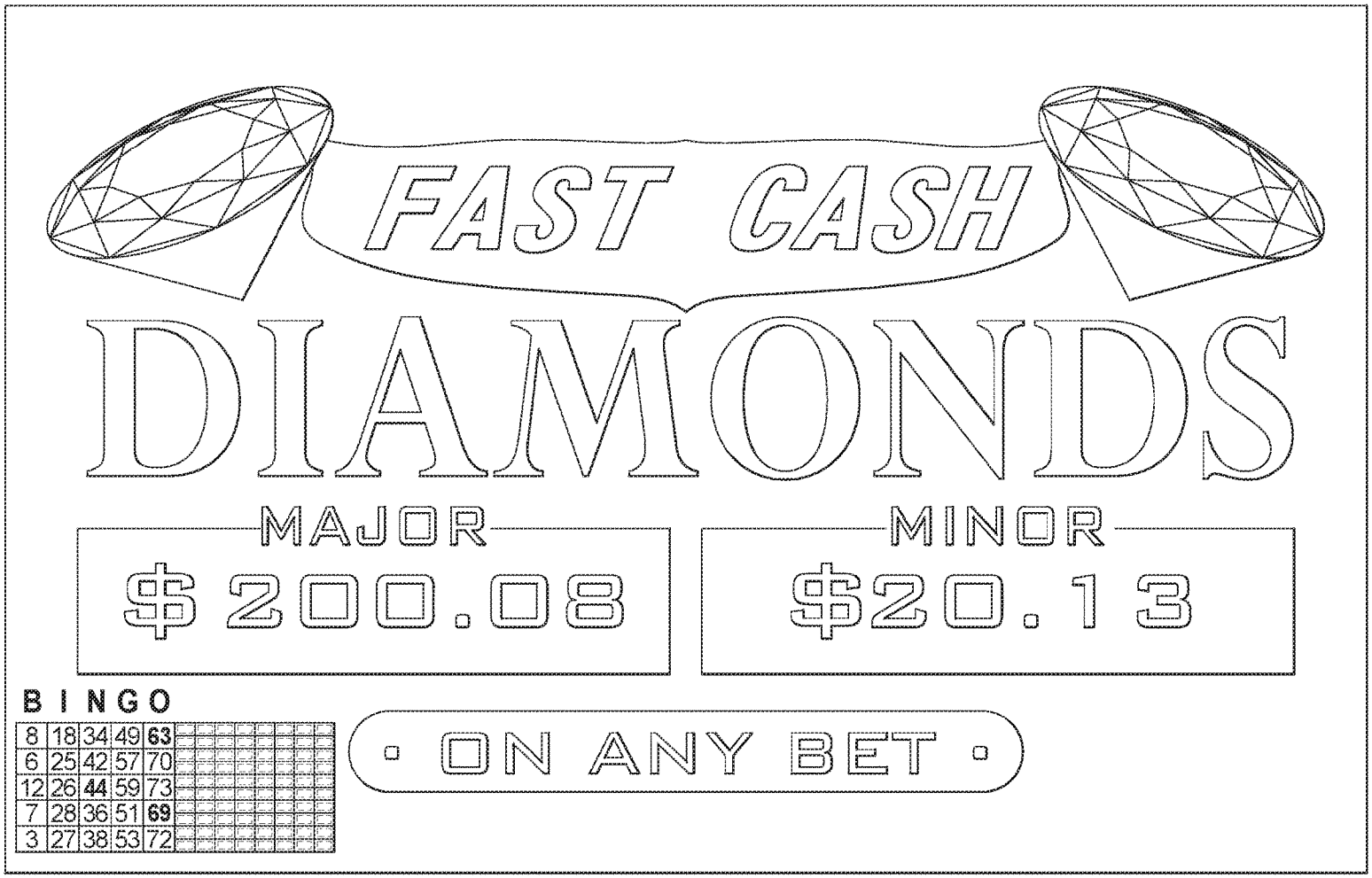
FIG. 6 is a screenshot of a second image displayed on the display of an electronic gaming machine illustrated in FIG. 1.

According to further embodiments, a bingo-type game with scaled prize may be played on the gaming machines 102 as a primary game, while a plurality of bingo-type games with progressive prizes or awards may be provided as well. See, for example, FIG. 6, which is a screenshot of a gaming machine 102 in an embodiment of the system 100 where major and minor progressive prizes are offered. The bingo-type games with progressive prizes may be implemented by the system 100 in accordance with the method 250, or the system 100 may implement one or more of the bingo-type games with progressive prizes in accordance with the method 250 and one or more of the bingo-type games with progressive prizes where the participants include only those gaming machines 102 where the wager received is in the maximum amount. According to any of these additional embodiments, different patterns or pattern sets may be used for the primary game and each of the progressive games provided (e.g., a small progressive, a medium progressive, a large progressive and a jumbo progressive).

The determination as to the player payout in such a circumstance may be dependent upon which pattern set is under consideration. That is, in a setting where there are five sessions being simultaneously played (primary and four progressives), five different pattern sets may be compared for each session, with the possibility of multiple win events for each pattern set and among the progressive pattern sets. In such a circumstance, the player may receive, for example, the prize or award with the highest value in regard to the primary event, and the highest progressive award among the games with progressive prizes. According to other embodiments, all of the prizes may be provided.

Alternatively, the determination as to the player payout may be made on a card-by-card basis. That is, in a situation where multiple patterns are being considered over multiple cards, it is possible to have more than one win event per card. In this case, the prize or award with the highest value for that card may be provided to the player, irrespective of whether the prize is for the primary or one of the games with a progressive prize. Again, according to other embodiments, all of the prizes may be provided.

While the use of multiple cards in proportion to the wager received by the player addresses issues unique to bingo-games with progressive prizes, it may be possible to the use of the method 250 in settings other than those where a progressive prize is to be awarded. For example, issuing additional cards in keeping with the size of the wager may be used in primary or base games or bonus games as well.

Figure 7:
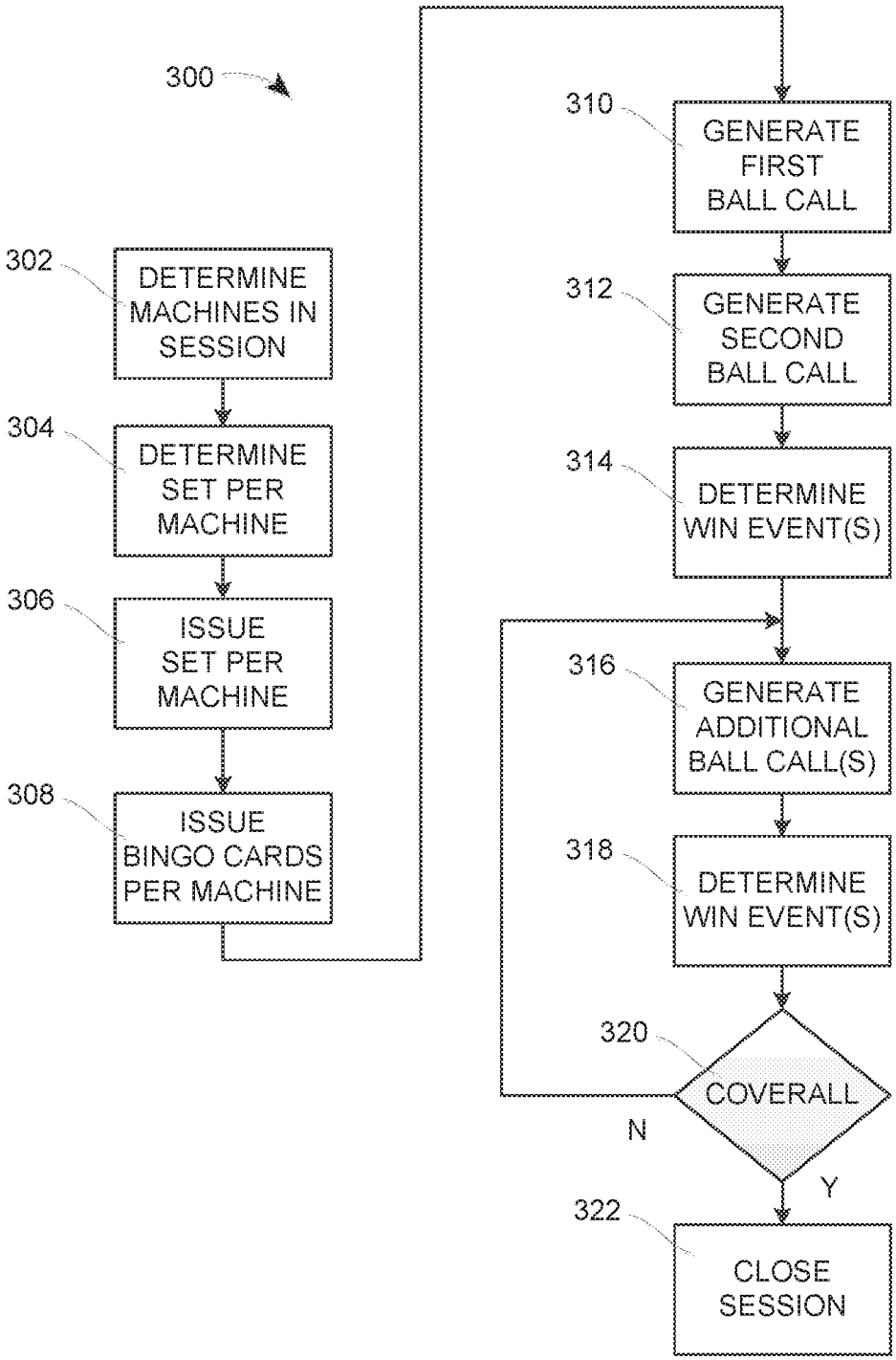
FIG. 7 is a method of operating the system of FIG. 1 to provide plurality of bingo-type games.

In a similar fashion, while use of a plurality of patterns permits separate patterns to be evaluated for different prizes (e.g., a scaled prize and a progressive prize), it is also possible to use different patterns for different wager amounts. Such a method 300 is illustrated in FIG. 7, where the server 104 makes an initial determination at block 302 as to which gaming machines 102 are participating. In accordance with this variant, the server 104 then determines at block 304 the pattern set to use in accordance with the wager received at a particular gaming machine 102. The pattern sets and bingo cards (i.e., one virtual bingo card per gaming machine 102) are then issued to the machines 102 at blocks 306, 308, with the remainder of the blocks 310, 312, 314, 316, 318, 320, 322 in common with methods 200, 250 above, except that the patterns used in blocks 314, 318 will depend on the patterns issued in accordance with the wagers received. Method 300 would permit the probability of a win event for a prize to vary with the wager amount. Method 300 also may be used in conjunction with the assignment of additional virtual bingo cards, as in method 250, to provide for a wider variety of probabilities in that both the pattern and the number of cards assigned at each wager level or amount may affect the probability that a prize will be awarded.

While multiple patterns may be used during a single session as described above, for example where a primary game and one or more progressives are played simultaneously or where different patterns are used based on different wager amounts, it is also possible to introduce additional patterns for the determination of win events at a point after the initiation of a session. For example, a special pattern evaluation may be triggered based on an event that occurs during a session or over a number of sessions. For example, a special pattern evaluation may be triggered based on a specific number of sessions played or a particular amount of wager received at a particular gaming machine 102. The special pattern evaluation may be triggered instead based on a particular time of day or a particular day in the year. Further, the trigger may be a predetermined event or a random event.

According to certain embodiments, the win event determination in such a triggered special pattern evaluation may be performed not simply on the first and second sets or ball calls, but on the additional ball calls up to the coverall condition being reached relative to one of the players participating in the session during which the trigger occurred. The player associated with the gaming machine 102 where the win event was determined may receive a prize or award, whether than award is in the form of a progressive or other award, or a feature (e.g., free spins, quick pick, and multiplier). Because the prize or feature would necessarily be award during that session, the prize or feature may also be referred to as a "hits by" prize or feature.

The methods described above may be carried out with the gaming machine 102 as illustrated in FIGS. 1 and 2. An alternative embodiment of gaming machine is illustrated in FIGS. 8 and 9.

Figure 8:
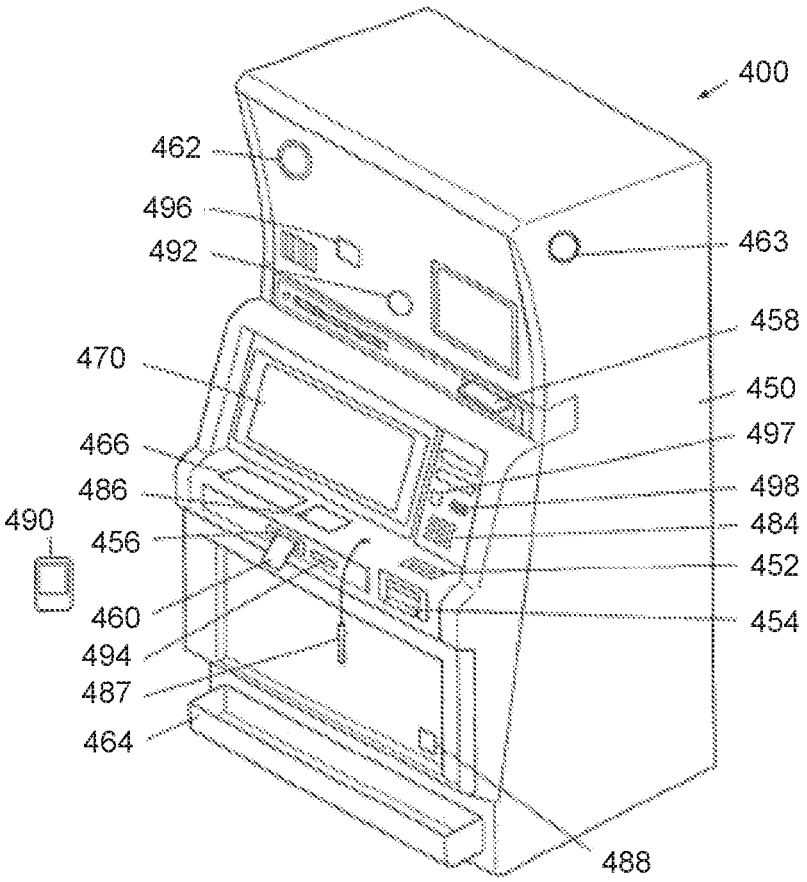
FIG. 8 is a perspective view of an alternative embodiment of an electronic gaming machine.
Figure 9:
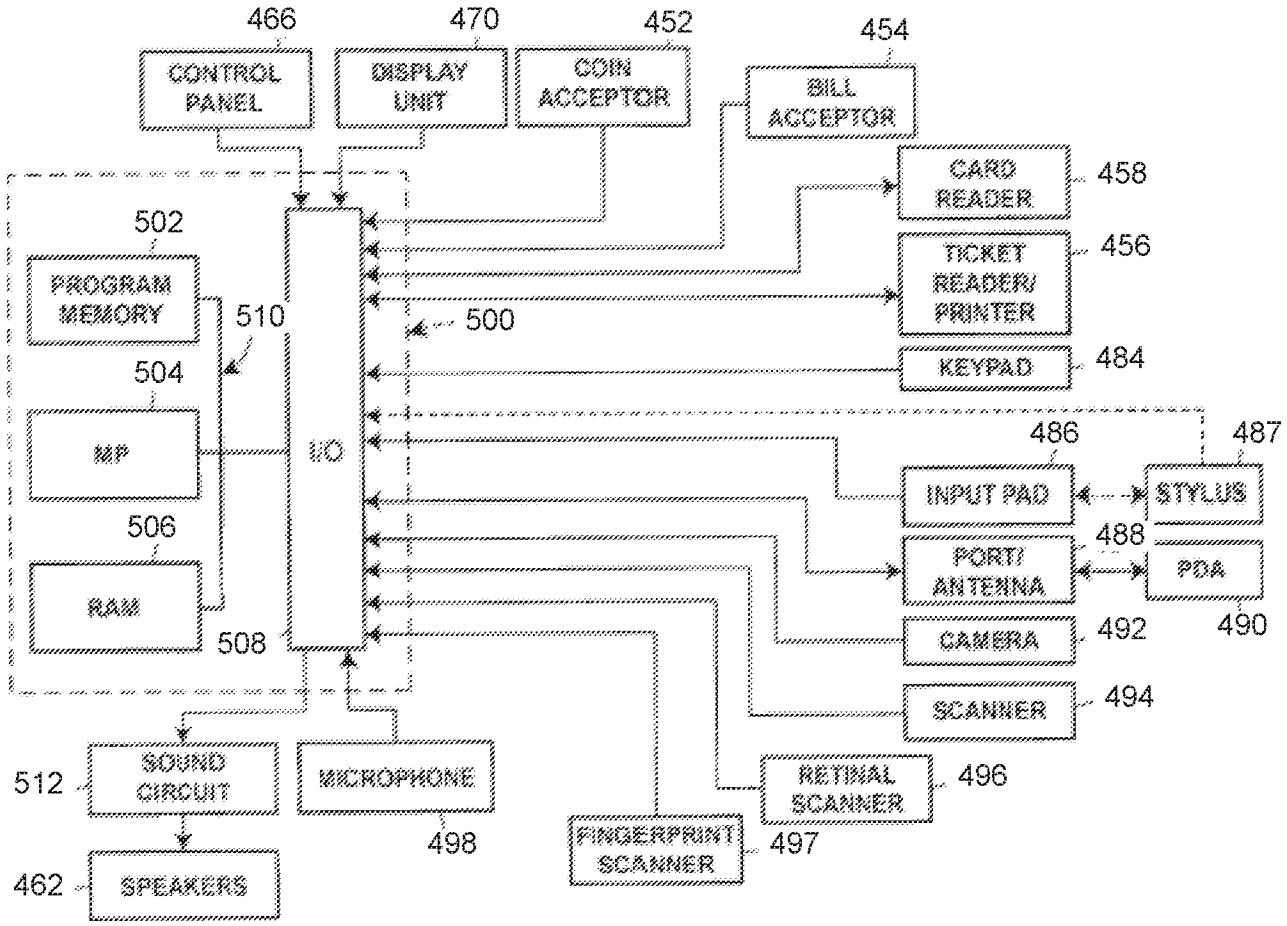
FIG. 9 is a block diagram of the electronic gaming machine of FIG. 8.

Referring to FIG. 8, another embodiment of the invention is shown in the form of an electronic gaming machine 400. The electronic gaming machine 400 may include a housing or cabinet 450 and one or more value transfer mechanisms or devices, which may include a coin slot or acceptor 452, a paper currency or bill acceptor 454, a ticket reader/printer 456 and a card reader 458 as illustrated, which may be used to input value to the electronic gaming machine 400. In general terms, a value transfer device may include any device that can accept value from a player, wherein term "value" means credits, gaming tokens, coins, paper, currency, tickets, vouchers, credit cards, debit cards, smart cards, memory devices capable of storing value (e.g., a memory card, smart card, a radio frequency identification (RFID) device, USB key, magnetic card or other electronic storage device) and any other object representative of value, and a value transfer device may include an electronic funds transfer device.

If provided on the electronic gaming machine 400, the ticket reader/printer 456 may be used to read and/or print or otherwise encode ticket vouchers 460. The ticket vouchers 460 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 460 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 460 could be printed with an optically readable material such as ink, or data on the ticket vouchers 460 could be magnetically encoded. The ticket reader/printer 456 may be provided with the ability to both read and print ticket vouchers 460, or it may be provided with the ability to only read or only print or encode ticket vouchers 460. In the latter case, for example, some of the electronic gaming machines 400 may have ticket printers 456 that may be used to print ticket vouchers 460, which could then be used by a player in other electronic gaming machines 400 that have ticket readers 456.

If provided, the card reader 458 may include any type of card reading device, such as a magnetic card reader or an optical card reader, and may be used to read data from a card offered by a player, such as a credit card or a player-tracking card. If provided for player tracking purposes, the card reader 458 may be used to read data from, and/or write data to, player tracking cards that are capable of storing data representing the identity of a player, the identity of a casino, the player's gaming habits, etc.

The electronic gaming machine 400 may include one or more audio speakers 462, a coin payout tray 464, an input control panel 466, and a color video display unit 470 for displaying images relating to the game or games provided by the electronic gaming machine 400. The audio speakers 462 may generate audio representing sounds such as the noise of spinning reels, a dealer's voice, music, announcements or any other audio related to a game. The input control panel 466 may be provided with a plurality of pushbuttons or touch-sensitive areas that may be pressed by a player to select games, make wagers, make gaming decisions, etc. The buttons used may depend on the game or games that could be played on the electronic gaming machine 400. As used herein, the term "button" is intended to encompass any device that allows a player to make an input, such as an input device that must be depressed to make an input selection or a display area that a player may simply touch. For example, the control panel 466 could be generated by the display unit 470. In that case, each of the buttons of the control panel 466 could be a colored area generated by the display unit 470, and some type of mechanism may be associated with the display unit 470 to detect when each of the buttons was touched, such as a touch-sensitive screen.

The electronic gaming machine 400 also may include a mechanism by which the electronic gaming machine 400 may determine the identity of the player. In particular, the card reader 458 may be used to read a card that carries an identification code that may be uniquely associated with the player so that the gaming unit can differentiate that player from all other players, or so that the gaming unit can differentiate that player as a member of a group of players from all player not a member of the group of players. The electronic gaming machine 400 may also include equipment, such as a keypad 484, an input pad 486 (with optional stylus 487), a port (or antenna) 488 adapted to communicate via a wired or wireless link (infrared or radio frequency link, for example) to a mobile electronic device 490 (such as a personal digital assistant, smart phone or tablet), a camera 492, a scanner 494, a retinal (or iris) scanner 496, fingerprint scanner 497, and/or a microphone 498. The electronic gaming machine 400 may include any one of the devices 458, 484, 486, 488, 490, 492, 494, 496, 497, 498, or the electronic gaming machine 400 may include a combination of some or all of the devices 458, 484, 486, 487, 488, 490, 492, 494, 496, 497, 498.

In operation, a player may identify him or herself to the electronic gaming machine 400 by entering a unique numeric or alphanumeric code using the key pad 484, for example. Alternatively, the player may use his or her finger or the stylus 487 to sign his or her signature on the input pad 486. As a further alternative, the player may sign his or her signature on the mobile electronic device 490, which signature is then converted to electronic data, and the data is then transferred via the port/antenna 488 to the electronic gaming machine 400. As yet another alternative, the player may sign his or her signature on a piece of paper that is then photographed using the camera 492 or scanned using the scanner 494 (or the bill acceptor 454) to convert the signature into electronic data. As an additional alternative, the player may place one of his or her fingers or his or her hand on the scanner 497, and the scanner 497 may generate an electronic data representation of the fingerprint on one or more of the player's fingers or an electronic data representation of the pattern of the entire hand. Alternatively, the camera 492 may be used to take a picture (live or still) of the player, the picture then being converted into electronic data. As a still further alternative, the player may place his or her eye up to the retinal (or iris) scanner 496, and the retinal (or iris) scanner 496 may generate an electronic data representation corresponding to the pattern of the retina (or iris) of the player. As yet another alternative, the player may speak into the microphone 498, and characteristics of the spoken words (or voiceprint) may be converted into an electronic data representation.

FIG. 9 is a block diagram of a number of components that may be incorporated in the electronic gaming machine 400. Referring to FIG. 9, the electronic gaming machine 400 may include a controller 500 that may comprise a program memory 502, a microcontroller or microprocessor (MP) 504, a random-access memory (RAM) 506 and an input/output (I/O) circuit 508, all of which may be interconnected via an address/data bus 510. It should be appreciated that although only one microprocessor 504 is shown, the controller 500 may include multiple microprocessors 504. Similarly, the memory of the controller 500 may include multiple RAMs 506 and multiple program memories 502. Although the I/O circuit 508 is shown as a single block, it should be appreciated that the I/O circuit 508 may include a number of different types of I/O circuits. The RAM(s) 504 and program memories 502 may be implemented as semiconductor memories, magnetically readable memories, and/or optically readable memories, for example.

FIG. 9 illustrates that the coin acceptor 452, the bill acceptor 454, the ticket reader/printer 456, the card reader 458, the control panel 466, the display unit 470, the keypad 484, the input pad 486 (and optionally the stylus 487), the port/antenna 488, the digital camera 492, the scanner 494, the retinal scanner 496, the fingerprint scanner 497 and the microphone 498 may be operatively coupled to the I/O circuit 508, each of those components being so coupled by either a unidirectional or bidirectional, single-line or multiple-line data link, which may depend on the design of the component that is used. The speaker(s) 462 may be operatively coupled to a sound circuit 512, that may comprise a voice- and sound-synthesis circuit or that may comprise a driver circuit. The sound-generating circuit 512 may be coupled to the I/O circuit 508.

As shown in FIG. 9, the components 452, 454, 456, 458, 466, 470, 484, 486, 487, 488, 492, 494, 496, 497, 498, 512 may be connected to the I/O circuit 508 via a respective direct line or conductor. Different connection schemes could be used. For example, one or more of the components shown in FIG. 9 may be connected to the I/O circuit 508 via a common bus or other data link that is shared by a number of components. Furthermore, some of the components may be directly connected to the microprocessor 504 without passing through the I/O circuit 508.

It will be recognized that other embodiments of the electronic gaming device may include fewer than all of the components illustrated in FIGS. 8 and 9, but greater than the components illustrated in FIGS. 1 and 2. Further, it is possible for embodiments of the electronic gaming device to include components in addition to those illustrated either the embodiment of FIGS. 1 and 2 or the embodiment of FIGS. 8 and 9. These embodiments are provided for exemplary purposes only.

Although the preceding text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph (pre-AIA) or § 112(f) (AIA).

What is claimed is:

1. An electronic gaming system for playing a bingo-type game, the system comprising:

a plurality of electronic gaming machines including a display, a wager acceptor to receive value in the form of coin, bill or ticket and a controller coupled to the display and the wager acceptor; and a server in communication with the gaming machine, the server configured to:

determine the electronic gaming machines participating in a session of a bingo-type game with a scaled prize and a progressive prize;

collect a percentage of a wager received at each of the electronic gaming machines to participate in the session, wherein a size of the wager received at each of the electronic gaming machines varies among the plurality of electronic gaming machines, and deposit the percentage of the wager into a progressive prize pot for the progressive prize;

determine a set of virtual bingo cards for the bingo-type game with the progressive prize for each of the electronic gaming machines participating the session only in accordance with the size of the wager received at each of the electronic gaming machines;

issue virtual bingo cards to each of the electronic gaming machines including at least one virtual bingo card for the scaled prize and the set of virtual bingo cards for the progressive prize;

generate one or more sets of indicia;

determine one or more win events based on the at least one virtual bingo card issued to each of the electronic gaming machines for the scaled prize and the one or more sets of indicia;

award one or more scaled prizes based on the one or more win events, wherein each of the one or more scaled prizes is determined based on a prize associated with the win event and the size of the wager received at the electronic gaming machine associated with the each of the one or more scaled prizes;

determine a progressive win event based on the set of virtual bingo cards issued to each of the electronic gaming machines for the progressive prize and the one or more sets of indicia; and award the progressive prize to the electronic gaming machine associated with the progressive win event.

2. The electronic gaming system according to claim 1, wherein the size of the wager varies in discrete amounts from 1 to n, and the set of virtual cards varies in number from 1 to n in direct proportionality to the size of the wager.

3. The electronic gaming system according to claim 2, wherein the size of the wager has a maximum amount and the set of virtual cards has a maximum number.

4. The electronic gaming system according to claim 1, wherein the determination of a progressive win is determined based on the set of virtual bingo cards, the one or more sets of indicia, and a first set of patterns, and the determination of the one or more win events are based on the the at least one virtual bingo card, the one or more sets of indicia, and a second set of patterns, the second set of patterns being different from the first set of patterns.

5. The electronic gaming system according to claim 1, wherein the one or more electronic gaming machines associated with the progressive win event and the one or more scaled win events display one or more images on the display, the one or more images associated with the progressive win event or one of the one or more scaled win events.

6. The electronic gaming system according to claim 5, wherein the one or more images are of a slot-type game.

7. The electronic gaming system according to claim 6, wherein the one or more images are selected from a plurality of slot-type game images.

8. An electronic gaming system for playing a bingo-type game, the system comprising:

a plurality of electronic gaming machines including a display, a wager acceptor to receive value in the form of coin, bill or ticket and a controller coupled to the display and the wager acceptor; and a server in communication with the gaming machine, the server configured to:

determine the electronic gaming machines participating in a session of a bingo-type game with a scaled prize and a progressive prize;

collect a percentage of a wager received at each of the electronic gaming machines to participate in the session, wherein a size of the wager received at each of the electronic gaming machines varies among the plurality of electronic gaming machines, and deposit the percentage of the wager into a progressive prize pot for the progressive prize;

determine a set of virtual bingo cards for the bingo-type game with the progressive prize for each of the electronic gaming machines participating the session only in accordance with the size of the wager received at each of the electronic gaming machines;

issue virtual bingo cards to each of the electronic gaming machines including at least one virtual bingo card for the scaled prize and the progressive prize and the set of virtual bingo cards for the progressive prize;

generate one or more sets of indicia;

determine one or more win events based on the at least one virtual bingo card issued to each of the electronic gaming machines for the scaled prize and the progressive prize and the one or more sets of indicia;

award one or more scaled prizes based on the one or more win events, wherein each of the one or more scaled prizes is determined based on a prize associated with the win event and the size of the wager received at the electronic gaming machine associated with the each of the one or more scaled prizes;

determine a progressive win event based on the at least one virtual bingo card issued to each of the electronic gaming machines for the scaled prize and the progressive prize and the set of virtual bingo cards issued to each of the electronic gaming machines for the progressive prize and the one or more sets of indicia; and award the progressive prize to the electronic gaming machine associated with the progressive win event.

9. The electronic gaming system according to claim 8, wherein the size of the wager varies in discrete amounts from 1 to n, and the set of virtual cards varies in number from 1 to n in direct proportionality to the size of the wager.

10. The electronic gaming system according to claim 9, wherein the size of the wager has a maximum amount and the set of virtual cards has a maximum number.

11. The electronic gaming system according to claim 8, wherein the determination of a progressive win is determined based on the at least one virtual bingo card and the set of virtual bingo cards, the one or more sets of indicia, and a first set of patterns, and the determination of the one or more win events are based on the at least one virtual bingo card, the one or more sets of indicia, and a second set of patterns, the second set of patterns being different from the first set of patterns.

12. The electronic gaming system according to claim 8, wherein the one or more electronic gaming machines associated with the progressive win event and the one or more scaled win events display one or more images on the display, the one or more images associated with the progressive win event or one of the one or more scaled win events.

13. The electronic gaming system according to claim 12, wherein the one or more images are of a slot-type game.

14. The electronic gaming system according to claim 13, wherein the one or more images are selected from a plurality of slot-type game images.

* * * * *